US012459622B1

(12) United States Patent
McEathron et al.

(10) Patent No.: US 12,459,622 B1
(45) Date of Patent: Nov. 4, 2025

(54) MARINE DRIVES AND APPARATUSES FOR STEERING MARINE DRIVES AND FOR ROUTING FLEXIBLE RIGGING CONNECTORS ON MARINE DRIVES

(71) Applicant: Brunswick Corporation, Mettawa, IL (US)

(72) Inventors: William W. McEathron, Fond du Lac, WI (US); Wayne M. Jaszewski, West Bend, WI (US); Wayne T. Terry, Fond du Lac, WI (US)

(73) Assignee: Brunswick Corporation, Mettawa, IL (US)

( * ) Notice: Subject to any disclaimer, the term of this patent is extended or adjusted under 35 U.S.C. 154(b) by 501 days.

(21) Appl. No.: 17/972,691

(22) Filed: Oct. 25, 2022

(51) Int. Cl.

| | |
|---|---|
| ***B63H 20/12*** | (2006.01) |
| ***B63H 20/02*** | (2006.01) |
| ***B63H 20/10*** | (2006.01) |
| ***B63H 20/32*** | (2006.01) |

(52) U.S. Cl.
CPC ..... *B63H 20/12* (2013.01); *B63H 20/02* (2013.01); *B63H 20/32* (2013.01); *B63H 2020/103* (2013.01)

(58) Field of Classification Search
CPC ..... B63H 20/12; B63H 20/02; B63H 20/32; B63H 2020/103
See application file for complete search history.

(56) References Cited

U.S. PATENT DOCUMENTS

| | | | | |
|---|---|---|---|---|
| 2,703,989 | A | 3/1955 | Schroeder | |
| 4,375,356 | A | 3/1983 | Stevens | |
| 4,739,801 | A | 4/1988 | Kimura | |
| 4,969,847 | A | 11/1990 | Curtis et al. | |
| 5,007,858 | A | 4/1991 | Daly et al. | |
| 5,054,944 | A | 10/1991 | Matsuyama | |
| 5,078,629 | A | 1/1992 | Mondek | |
| 5,556,310 | A | 9/1996 | Gandarillas | |
| 5,637,021 | A | 6/1997 | Watanabe | |
| 6,034,326 | A | 3/2000 | Jorgensen | |
| 6,093,066 | A * | 7/2000 | Isogawa | B63H 20/12 440/86 |
| 6,257,940 | B1 | 7/2001 | Dunham et al. | |
| 6,364,724 | B1 | 4/2002 | Nozawa et al. | |
| 6,387,002 | B1 | 5/2002 | Blase | |
| 6,902,450 | B2 | 6/2005 | Ohtsuki et al. | |
| 6,960,108 | B1 | 11/2005 | Jaszewski et al. | |

(Continued)

FOREIGN PATENT DOCUMENTS

| | | | | |
|---|---|---|---|---|
| JP | H10250688 | A * | 9/1998 | F02B 61/045 |

OTHER PUBLICATIONS

Unpublished U.S. Appl. No. 17/880,987, filed Aug. 4, 2022.

(Continued)

*Primary Examiner* — Stephen P Avila

(74) *Attorney, Agent, or Firm* — Andrus Intellectual Property Law, LLP

(57) ABSTRACT

A marine drive for propelling a marine vessel in water, the marine drive comprising a cowling defining a cowling interior, a steering arm for steering the marine drive with respect to a steering axis; and a flexible rigging connector extending from the cowling interior to a location in the marine vessel, wherein the flexible rigging connector extends through the steering arm and coaxial with the steering axis.

24 Claims, 6 Drawing Sheets

(56) References Cited

U.S. PATENT DOCUMENTS

| | | | | |
|---|---|---|---|---|
| 7,104,856 | B1 | 9/2006 | Krupp et al. | |
| 7,214,113 | B2 | 5/2007 | Kojima | |
| 7,442,104 | B2 | 10/2008 | Okabe | |
| 7,704,109 | B2 | 4/2010 | Arai et al. | |
| 7,883,385 | B2 | 2/2011 | Sakamoto | |
| 8,658,904 | B2 | 2/2014 | Naganuma et al. | |
| 8,858,280 | B1 | 10/2014 | Wiegele et al. | |
| 9,365,277 | B2 | 6/2016 | Skrzypchak et al. | |
| 9,493,221 | B2 | 11/2016 | Cordell | |
| 9,764,813 | B1 | 9/2017 | Zarembka et al. | |
| 9,783,278 | B1 | 10/2017 | Dannenberg et al. | |
| 9,789,945 | B1 | 10/2017 | Vaninetti et al. | |
| 10,017,136 | B1 * | 7/2018 | Waisanen ..... | B63H 20/32 |
| 10,046,842 | B2 | 8/2018 | Mizutani | |
| 10,202,180 | B1 | 2/2019 | Amerling et al. | |
| 10,246,173 | B1 | 4/2019 | Ingebritson | |
| 10,286,989 | B1 | 5/2019 | Amerling et al. | |
| 10,696,367 | B1 | 6/2020 | Ingebritson et al. | |
| 10,710,691 | B2 | 7/2020 | Amerling et al. | |
| 11,046,405 | B1 | 6/2021 | Groeschel et al. | |
| 11,066,140 | B1 | 7/2021 | Huffer et al. | |
| 11,084,563 | B1 | 8/2021 | Pielow et al. | |
| 11,377,186 | B1 | 7/2022 | Ahlswede et al. | |
| 2004/0083655 | A1 | 5/2004 | Suzuki | |
| 2004/0226737 | A1 | 11/2004 | Ide et al. | |
| 2011/0170733 | A1 | 7/2011 | Aase | |
| 2018/0170501 | A1 | 6/2018 | Gai et al. | |
| 2024/0253912 | A1 | 8/2024 | Tanaka | |

OTHER PUBLICATIONS

Unpublished U.S. Appl. No. 17/585,214, filed Jan. 26, 2022.
Navy Series Electric Outboard/ePropulsion, https://www.epropulsion.com/navy/?wpmeteordisable=1, accessed Aug. 10, 2022.
Outboard—Cruise 10.0 T—Torqeed, https://www.torqeedo.com/US/en-US/products/outboards/cruise/cruise-10.0-t/M-1243-20.html, accessed Aug. 10, 2022.
Office Action issued in U.S. Appl. No. 18/092,764, dated Jun. 18, 2025.

* cited by examiner

MARINE DRIVES AND APPARATUSES FOR STEERING MARINE DRIVES AND FOR ROUTING FLEXIBLE RIGGING CONNECTORS ON MARINE DRIVES

FIELD

The present disclosure relates to marine drives and particularly to steering arrangements for marine drives having flexible rigging connectors.

BACKGROUND

The following U.S. Patents provide additional background and are incorporated herein by reference.

U.S. Pat. No. 11,377,186 discloses an apparatus for operably connecting a marine drive to a marine vessel. A transom bracket is configured for fixed attachment to the marine vessel and for attachment to the marine drive such that the marine drive is trimmable up and down relative to the marine vessel about a trim axis. The transom bracket has a sidewall with a rigging opening through which at least one elongated rigging member extends for operably connecting the marine drive to the marine vessel, wherein the rigging opening is located along the trim axis. The rigging device has an elbow conduit with an inlet end and an outlet end, wherein the outlet end is positionable into a plurality of clock positions relative to the inlet end.

U.S. Pat. No. 11,046,405 discloses a rigging hose housing provided to couple a rigging hose to a marine vessel. The rigging hose housing includes a radial mounting plate; an outer cylindrical wall extending perpendicularly from the radial mounting plate a first height above a bottom surface of the radial mounting plate; an inner cylindrical wall extending perpendicularly from the radial mounting plate a second height above the bottom surface of the radial mounting plate; and a gutter formed between the inner cylindrical wall and the outer cylindrical wall. The gutter terminates in a drain hole formed in the outer cylindrical wall. The drain hole is configured to permit the expulsion of fluid collected in the gutter from the rigging hose housing.

U.S. Pat. No. 10,710,691 discloses a marine drive including an engine and a cowl having first and second cowl portions. The first cowl portion is movable with respect to the second cowl portion into an open position in which the engine is manually accessible and a closed position in which the engine is enclosed; and a rigging port in the second cowl portion. The rigging port provides a passageway for rigging connectors extending from the engine to a component located remotely from the engine. A rigging opening provides manual access to the rigging connectors and the engine, including when the first cowl portion is in the closed position. A removable access door covers the rigging opening and prevents manual access to the engine and rigging connectors via the rigging opening. The removable access door is fastened to the second cowl portion by a removable fastener that is hidden from view.

U.S. Pat. No. 10,202,180 discloses an outboard motor including an engine coupled in torque-transmitting relationship with a propulsor via a driveshaft. A protective covering for the outboard motor includes a cowl that houses the engine within a closed interior thereof. An opening in an outer surface of the cowl provides access to the closed interior. A rigging tray can be inserted through the opening to a retracted position, in which a majority of the rigging tray is within the closed interior. A plurality of electrical lines extends from the engine and into the rigging tray from a first end thereof. Each electrical line in the plurality of electrical lines terminates in the rigging tray at a respective one of a plurality of electrical connectors. A second end of the rigging tray receives a complementary plurality of vessel electrical lines for connection to the plurality of engine electrical lines via the plurality of electrical connectors.

U.S. Pat. No. 10,017,136 discloses an outboard motor which can be coupled to a transom of a marine vessel via a rigging system. The rigging system includes a plurality of engine-sourced lines extending from an engine of the outboard motor, through an aperture in the motor housing, and to the marine vessel. A protective tube surrounds the plurality of engine-sourced lines and has a first end coupled to the motor housing and a second end coupled to the marine vessel. A rigging center is located aboard the marine vessel and holds distal ends of each of the engine-sourced lines. A plurality of connectors is provided on the distal ends of the engine-sourced lines. At the rigging center, each engine-sourced line is configured to be coupled, via a respective connector, to a corresponding vessel-sourced line. The vessel-sourced lines are in turn connected to respective engine-related devices aboard the marine vessel.

U.S. Pat. No. 7,104,856 discloses a rigging apparatus provided for an outboard motor in which an attachment member is shaped to be rigidly attached to a housing structure, or cowl, of an outboard motor, without the need for additional hardware such as clamps, brackets, or screws. The attachment member is shaped to receive a threaded sleeve in threaded association therewith so that hoses, wires, and cables can be protected within the threaded sleeve. An attachment member of the rigging apparatus is made to be asymmetrical to avoid improper assembly into an opening of the housing structure of an outboard motor.

SUMMARY

This Summary is provided to introduce a selection of concepts which are further described herein below in the Detailed Description. This Summary is not intended to identify key or essential features of the claimed subject matter, nor is it intended to be used as an aid in limiting scope of the claimed subject matter.

In non-limiting examples disclosed herein, a marine drive is for propelling a marine vessel in water. The marine drive may have a cowling defining a cowling interior; a steering arm for steering the marine drive with respect to a steering axis; and a flexible rigging connector extending from the cowling interior to a location in the marine vessel, wherein the flexible rigging connector extends through the steering arm. The steering arm may have a through-bore, wherein the flexible rigging connector extends through the through-bore. At least a portion of the flexible connector may extend coaxial with the steering axis. A guide member may guide the portion of the flexible rigging connector coaxial with the steering axis In non-limiting examples disclosed herein, a transom bracket assembly may be configured to couple the marine drive to the marine vessel, wherein the flexible rigging connector extends over the transom bracket assembly. The guide member may help guide the flexible rigging connector over the transom bracket assembly. The guide member comprises a base member and a cover which is removable from the base member, and wherein the base member and the cover together define a guide passage for the flexible rigging connector. The guide member may comprise at least one bend for redirecting the flexible rigging connector. The guide member may be coupled to a swivel bracket of the transom bracket assembly such that the guide member moves with the marine drive when the marine drive is trimmed about the trim axis.

In non-limiting examples disclosed herein, a marine drive is for propelling a marine vessel in water. The marine drive comprises a cowling defining a cowling interior; a steering arm for steering the marine drive with respect to a steering axis, wherein the steering arm comprises a through-bore for passage of a flexible rigging connector, wherein the through-bore is located along the steering axis such that at least a portion of the flexible rigging connector can extend coaxial with the steering axis.

BRIEF DESCRIPTION OF THE DRAWINGS

Examples are described with reference to the following drawing figures.

DETAILED DESCRIPTION

During research and development in the field of marine drives, the present inventors determined that rigging connectors extending from a marine drive to a marine vessel are often subject to bending and/or abrasion which may damage the rigging connectors over extended periods of time. Typical rigging members may include but are not limited to hoses, wires, cables, and/or the like, which extend between a marine vessel and a marine drive coupled to the vessel's transom. For example, the electrical system of the marine drive often includes a variety of electrical control and power components. A wiring harness may extend between the marine drive and a helm of the marine vessel. The wiring harness may contain electrical lines that relay digital steering, throttle, and shift commands between the helm and the marine drive. Electrical lines relaying other types of control signals may also be present. Additionally, battery cables may extend between one or more batteries housed within the vessel and terminals provided on the outboard motor. Moreover, in marine drives having an engine, one or more fuel lines may supply fuel to the engine from a fuel tank housed within the vessel. Many marine drives, such as outboard motors, have a tiller for steering. Because the tiller and associated steering arm are usually centered on the marine drive, rigging connectors may need to curve around the tiller and steering arm, which may cause significant movement of the rigging connectors when turning the marine drive. Repetitive movement may cause the connectors to rub against the transom bracket, the transom itself, or other parts of the marine vessel or marine drive support structure resulting in chafing of the connectors. Moreover, lengthy rigging connectors extending between the marine drive and the marine vessel can affect the styling of the marine drive and can otherwise be inconvenient for a number of reasons. Through research and experimentation, the present inventors determined it would be advantageous to provide features which support rigging connectors extending between the marine drive and the vessel such that the rigging connectors do not move/translate when the drive is steered from side to side and trimmed up and down. The present disclosure is a result of the present inventor's efforts in this regard.

Figure 1:
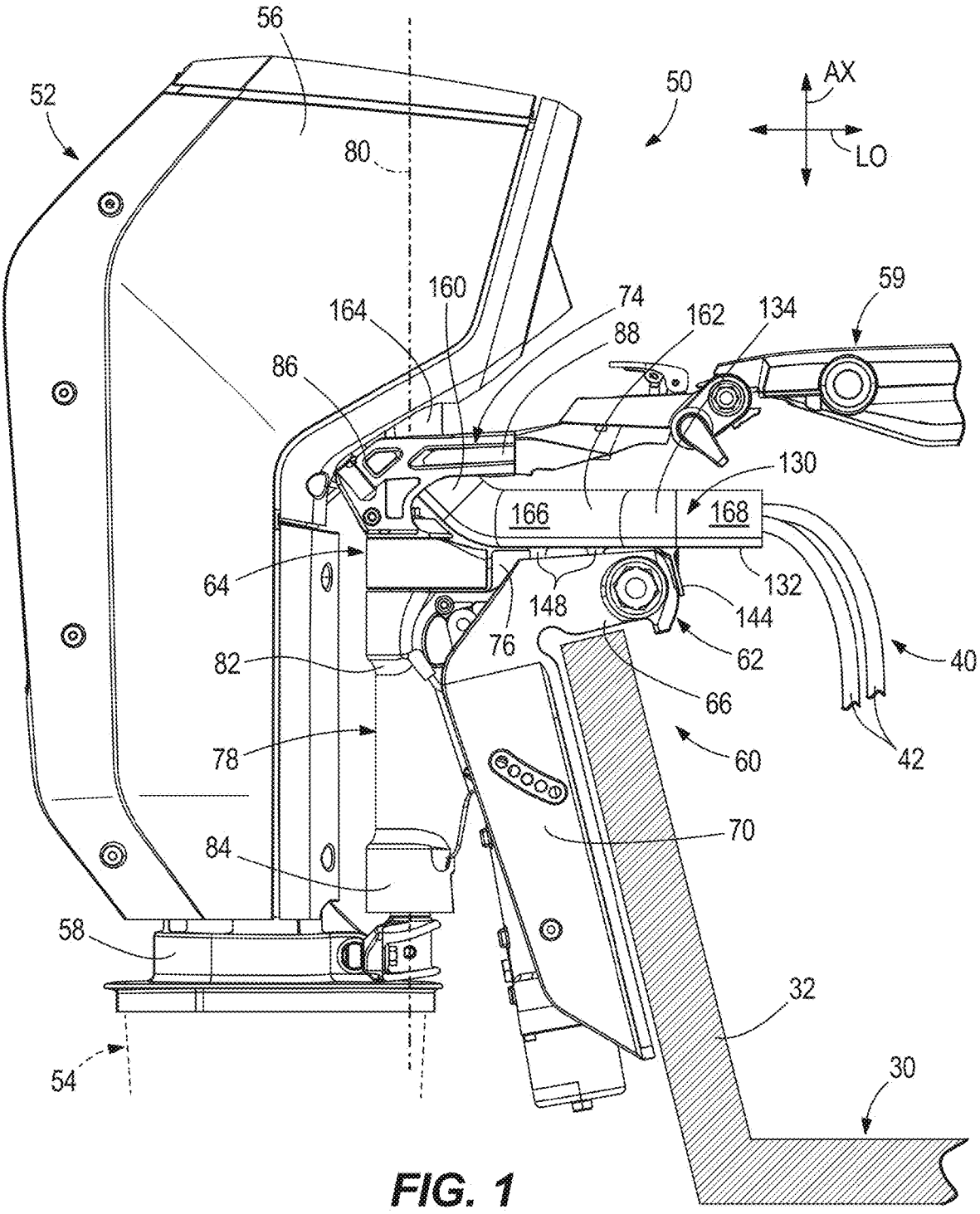
FIG. 1 is a side view of a marine drive according to the present disclosure supported on the transom of a marine vessel.
Figure 2:
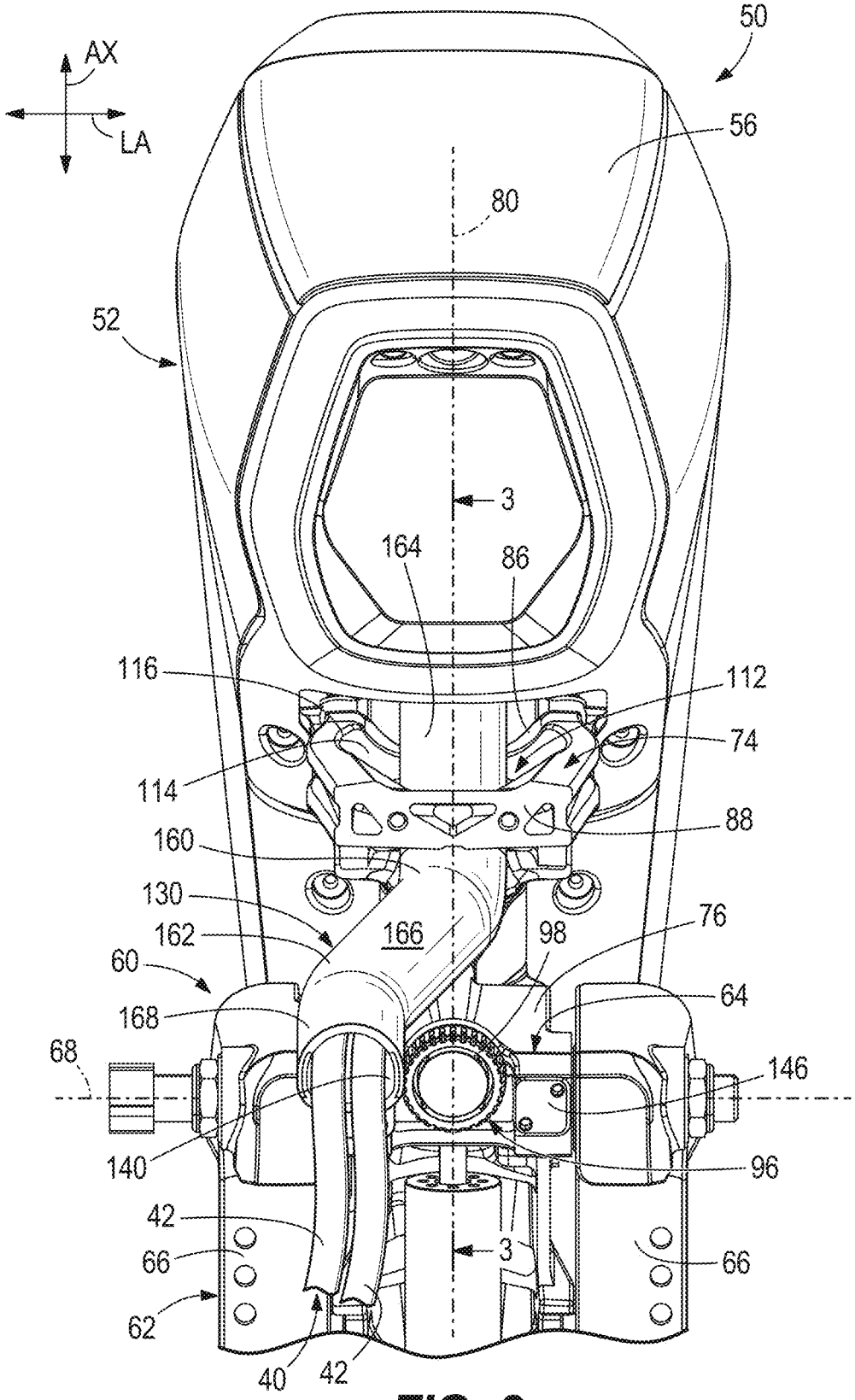
FIG. 2 is a front view of the marine drive of FIG. 1.

FIGS. 1 and 2 depicts a marine drive 50 for propelling a marine vessel in a body of water, which in the illustrated example is an outboard motor. The marine drive 50 extends from top to bottom in an axial direction AX, from front to back in a longitudinal direction LO which is perpendicular to the axial direction AX, and from side to opposite side in a lateral direction LA which is perpendicular to the axial direction AX and perpendicular to the longitudinal direction LO. The marine drive 50 includes an upper portion 52 and a lower portion 54, which is schematically depicted in FIG. 1. The upper portion 52 includes a cowling 56 that is fixed to and surrounds most or all of the body of a supporting frame 58, for example as further disclosed in U.S. patent application Ser. No. 17/585,214, the disclosure of which is hereby incorporated herein by reference in entirety. The cowling 56 defines a cowling interior 57 in which a portion of the supporting frame 58 is enclosed and various components of the marine drive 50 are disposed. It should be understood that the various components of the illustrated marine drive 50 are exemplary and could vary from what is shown.

The marine drive 50 is coupled to the transom 32 of a marine vessel 30 by a transom bracket assembly 60, which in the illustrated example includes a transom bracket 62 fixed to the transom 32 and a swivel bracket 64 pivotably coupled to the transom bracket 62. The transom bracket 62 has a pair of C-shaped arms 66 which fit over the top of the transom 32 and a pair of threaded, plunger-style clamps (not shown) which clamp the C-shaped arms 66 to the transom 32. Additionally or alternatively, the transom bracket 62 may be fixed to the transom 32 by fasteners. The type and configuration of the transom bracket 62 can vary from what is shown and described.

The swivel bracket 64 is pivotable with respect to the C-shaped arms 66 about a pivot shaft that laterally extends through the forward upper ends of the C-shaped arms 66, thereby defining a trim axis 68. Pivoting of the swivel bracket 64 about the pivot shaft trims the marine drive 50 relative to the marine vessel 30, for example out of and/or back into the body of water in which the marine vessel is operated. A selector bracket 70 having holes is provided on at least one of the C-shaped arms 66. Holes respectively become aligned with a corresponding mounting hole on the swivel bracket 64 at different selectable trim positions for the marine drive 50. A selector pin (not shown) can be manually inserted into the aligned holes to thereby lock the marine drive 50 in place with respect to the trim axis. Again, the type and configuration of the transom bracket 62 can vary from what is shown and described.

The marine drive 50 is supported on the swivel bracket 64 by a steering arm 74 and a steering tube 72 (see FIG. 3), which is which is fixed to the steering arm 74 with a fastener 94 and seated in a swivel cylinder 78 of the swivel bracket 64. The swivel cylinder 78 has an upper portion 82 connected to a swivel arm 76 of the swivel bracket 64 and a lower portion 84 which is connected to a lower portion the supporting frame 58. Using a manually operable tiller 59, the marine drive 50 can be steered left or right relative to the marine vessel 30 by rotating about a steering axis 80 defined by the steering tube 72 and swivel cylinder 78. The illustrated swivel bracket 64 includes an integrated copilot device 96 configured to retain the marine drive 50 in a plurality of steering orientations. A control dial 98 is positioned at a front end of the swivel arm 76 and can be used to operate the copilot device 96 to selectively fix the marine drive 50 in a particular steering orientation and/or to control the degree of resistance to steering movement of the marine drive 50 via the tiller 59. It should also be understood that the concepts of the present disclosure are not limited for use with marine drives having a tiller, but can also be useful with marine drives with other steering devices, including electric steering devices, hydraulic steering devices, electro-hydraulic steering devices, and/or the like, which can be locally and/or remotely controlled.

A flexible rigging connector 40 is configured to supply power to the marine drive 50 and extends from a location on the marine vessel 30 to the cowling interior 57. In the illustrated embodiments, the flexible rigging connector 40 includes two power cables 42 which extend from a battery (not shown) on the marine vessel 30 to power terminals 44 which are located in the cowling interior 57 and distribute power to the motor (not shown) in the lower portion 54 of the marine drive 50. Some embodiments, however, may include a differently configured flexible rigging connector 40. For example, the flexible rigging connector 40 may include at least one additional connecter, such as a communication line, a hydraulic line, a pneumatic line, and/or any other wire, cable, or connector for operating the marine drive 50.

Figure 3:
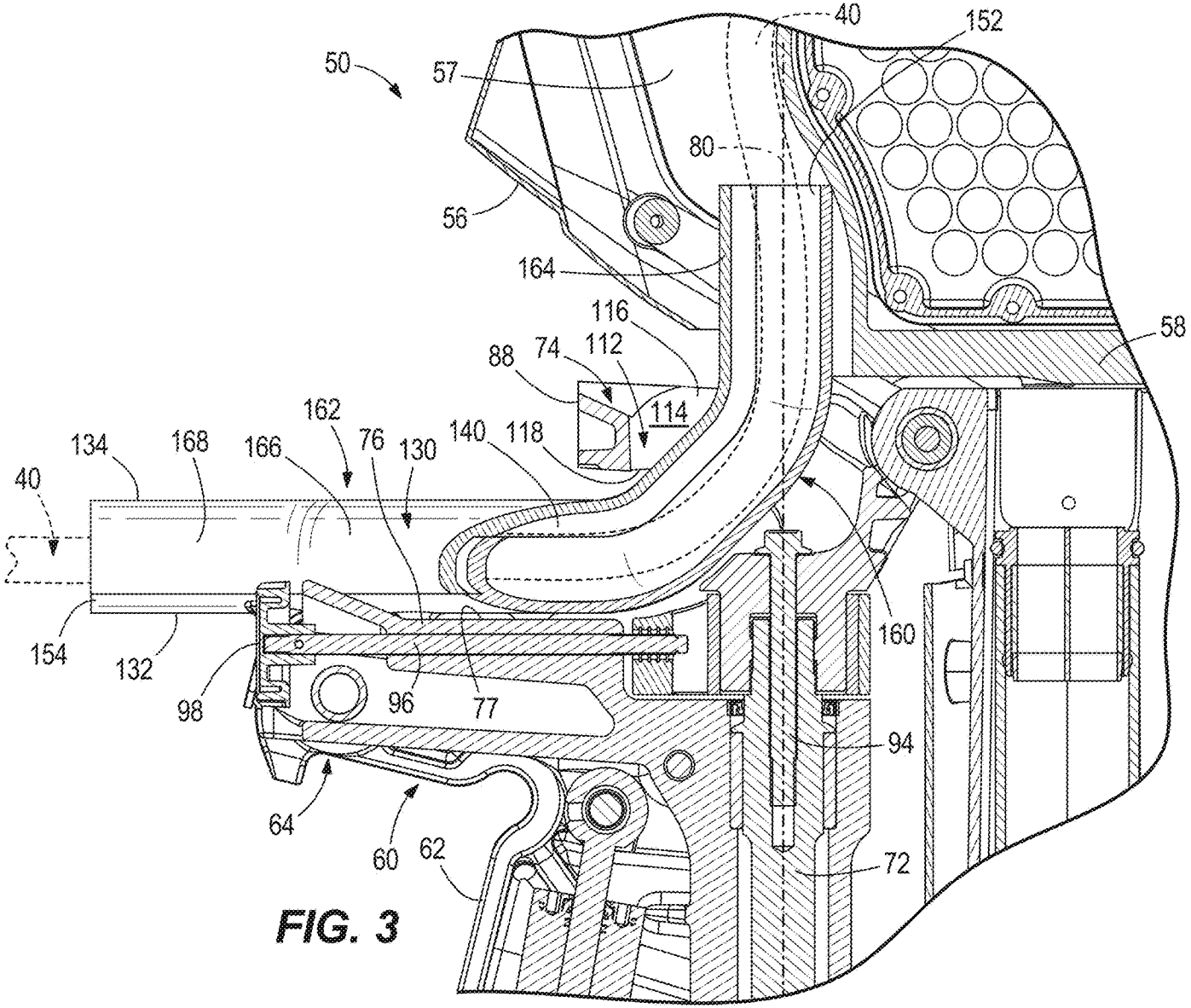
FIG. 3 is a view of section 3-3, taken in FIG. 2.
Figure 4:
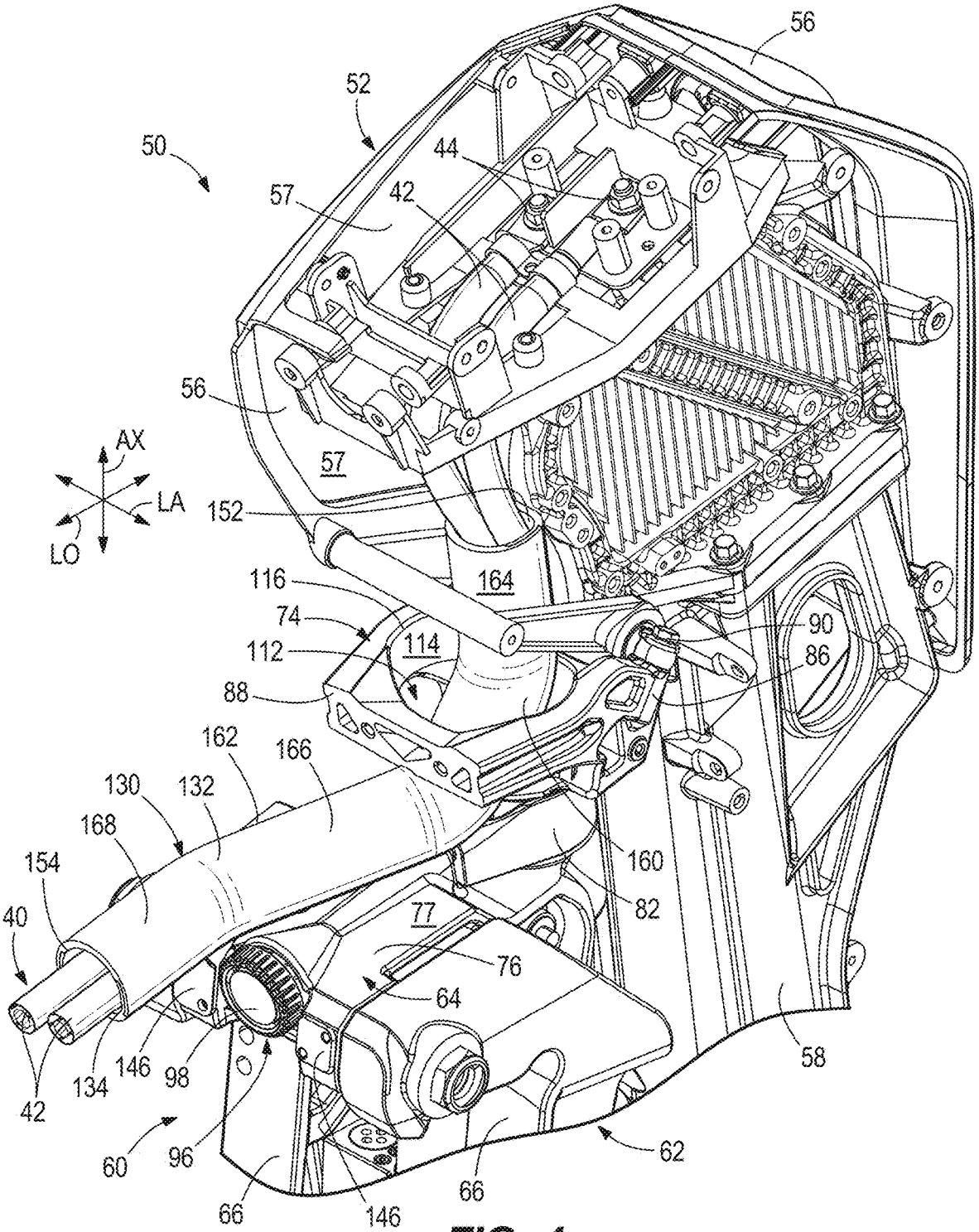
FIG. 4 is a perspective view of the marine drive of FIG. 2 with a portion of the cowling removed.
Figure 5:
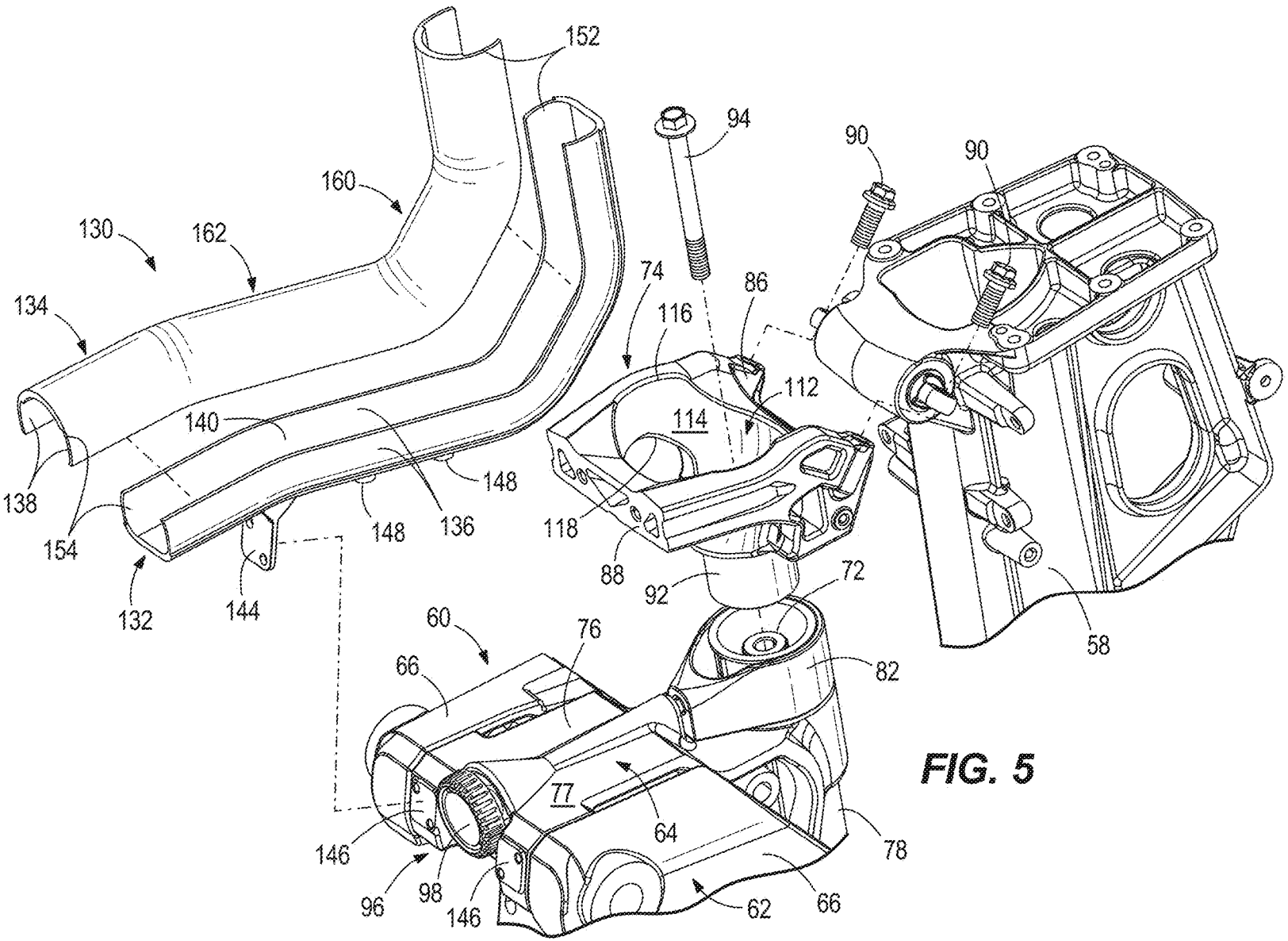
FIG. 5 is an exploded view of the transom bracket assembly, steering arm, supporting frame, and guide member from the marine drive of FIG. 4.

Referring to FIGS. 3-5, the steering arm 74 has a first end 86 which is coupled to a supporting frame 58 with fasteners 90 and an opposite, second end 88 configured to be coupled to the tiller 59. A cylindrical hub 92 extends downward from the body of the steering arm 74 and is coupled to the steering tube 72 by a fastener 94. The cylindrical hub 92 and the steering tube 72 are received in the upper portion 82 of the swivel cylinder 78 and are permitted to rotate therein so that the steering arm 74 pivots about the steering axis 80.

The steering arm 74 includes a through-bore 112 through which the flexible rigging connector 40 and a guide member 130 extend. The through-bore 112 is formed through the body of the steering arm 74 from top to bottom and defines a passageway 114 through the steering arm from an upper opening 116 to a lower opening 118. The through-bore 112 is located along the steering axis 80 such that at least a portion of the flexible rigging connector 40 extends coaxially with the steering axis 80 (see, e.g., FIG. 3). The upper opening 116 is positioned over the cylindrical hub 92 and steering tube 72 with at least a portion of the upper opening 116 in axial alignment with the steering axis 80. The lower opening 118 of the through-bore 112 is located between the cylindrical hub 92 and the second end 88 of the steering arm 74 so that the flexible rigging connector 40 and guide member 130 exit the passageway 114 below the second end 88. It should be noted that the shape and configuration of these components can vary widely from what is illustrated as long as the above-described functionality is provided. For example, the shape(s) and/or direction(s) of the through-bore can vary from what is shown and described to accommodate different embodiments. These can all be optimized based upon the particular embodiments.

Figure 6:
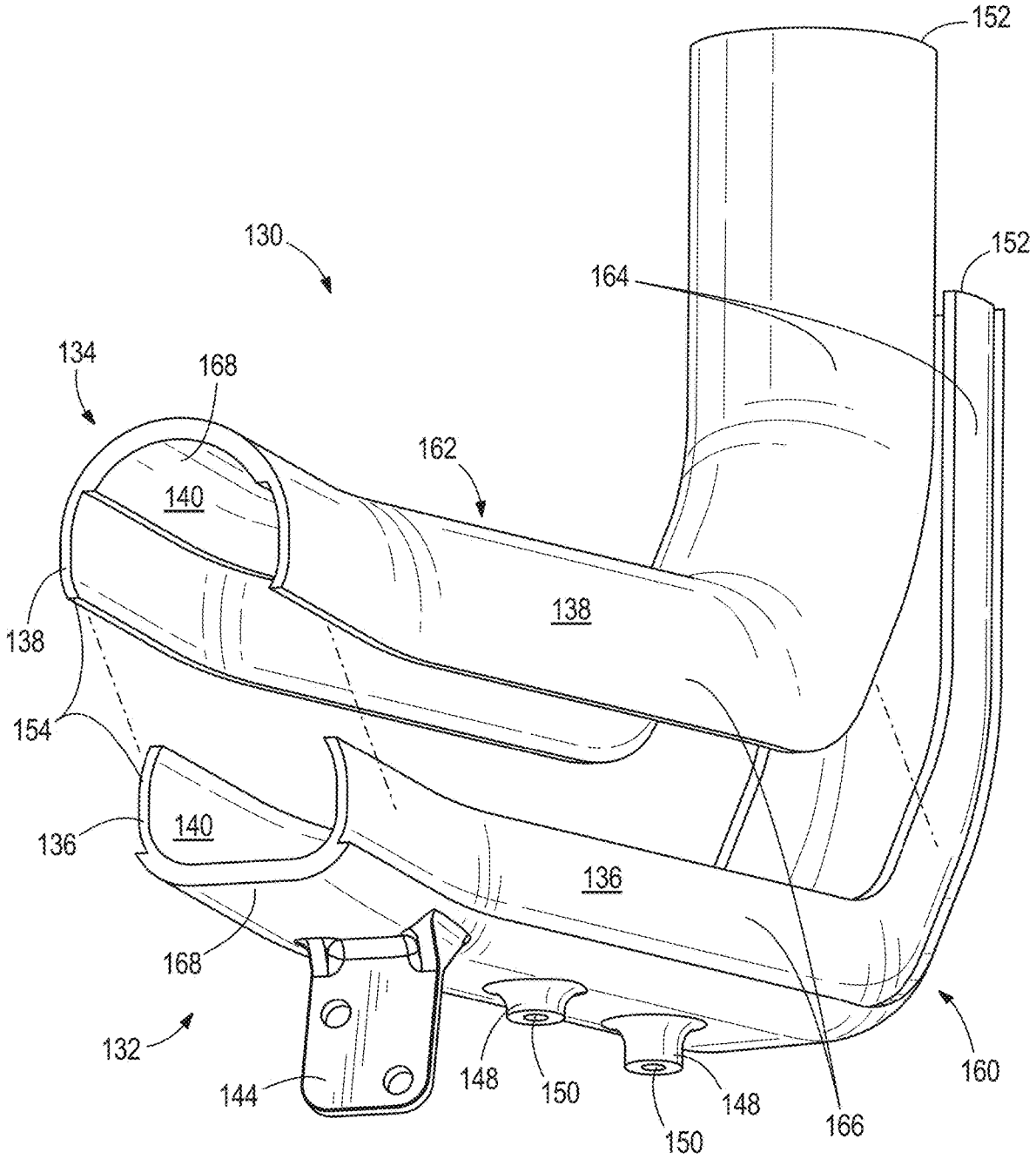
FIG. 6 is an exploded perspective view of the guide member of FIG. 5.

As illustrated in FIGS. 3 and 4, the guide member 130 is configured to guide the flexible rigging connector 40 through the steering arm 74 and over the transom bracket assembly 60. Referring to FIGS. 5 and 6, the illustrated guide member 130 includes a base member 132 and a cover 134 which is removable from the base member 132. The base member 132 includes curved sidewalls 136 that are nested within corresponding curved sidewalls 138 of the cover 134. The nested engagement between the sidewalls 136 of the base member 132 and the sidewalls 138 of the cover 134 creates an interference fit that couples the cover 134 to the base member 132.

In the illustrated embodiments, the guide member 130 is coupled to the swivel bracket 64 such that the guide member 130 moves with the marine drive 50 when the marine drive 50 is trimmed about the trim axis 68. A mounting tab 144 projects downwardly from a lower surface of the base member 132 and can be engaged by fasteners (not shown) to secure the base member 132 to a mounting surface 146 on the swivel bracket 64. The illustrated guide member 130 also includes two mounting members 148 that extends downwardly from a lower surface of the base member 132 and abut an upper surface 77 of the swivel arm 76. The mounting members 148 function as standoffs which space the guide member 130 apart from the transom bracket 62. In the illustrated embodiments, the mounting members 148 each include a through-bore 150 for securing the guide member 130 to the upper surface 77 with a fastener (not shown). In some embodiments, however, at least one of the mounting members 148 may not be coupled to the swivel arm 76 but still function as a standoff to space the guide member 130 apart from the transom bracket assembly 60. Some embodiments may include additional mounting points for securing the guide member 130 to the transom bracket assembly 60. For example, a guide member may include at least one additional mounting member and/or mounting tab, and at least one mounting member or mounting tab may be different than those of the illustrated embodiments. Additionally or alternatively, at least one of the mounting members and/or the mounting tab may be omitted.

When coupled together, the base member 132 and the cover 134 of the guide member 130 together define a guide passage 140 through which the flexible rigging connector 40 extends. The guide member 130 is positioned on the swivel bracket 62 so that a first end 152 of the guide passage 140 is located within the interior 57 of the cowling 56 and a second end 154 of the guide passage 140 is located in front of the transom bracket assembly 60 towards the bow of the marine vessel 30. Embodiments of the guide member 130 may include at least one bend for redirecting the flexible rigging connector 40. For example, referring to FIGS. 2-4, the illustrated guide member 130 includes a first bend 160 and a lateral jog 162. The first bend 160 is located proximate the first end 152 of the guide member 130 and transitions from a vertical segment 164 of the guide member 130 to a first horizontal segment 166. The lateral jog 162 transitions from the first horizontal segment 166, which is oriented at an angle relative to the longitudinal axis LO, to a second horizontal segment 168 that is laterally offset from and parallel to the longitudinal axis LO. Advantageously, the lateral jog 162 laterally offsets the flexible rigging connector 40 towards the starboard side of the marine vessel 30 so that the controls 98 of the copilot device 96 on the swivel bracket 62 are not obstructed by the guide member 130 or the flexible rigging connector 40.

In the illustrated embodiments, the first bend 152 of the guide member 130 extends through the through-bore 112 of the steering arm 74 such that at least a portion of the flexible rigging connector 40 is coaxial with the steering axis 80. In particular, as best illustrated in FIGS. 2 and 3, the guide passage 140 is generally coaxial with the steering axis 80 along the vertical segment 164 of the guide passage 140. Thus, the guide member 130 guides the flexible rigging connector through the steering arm 74 such that flexible rigging connector 40 (and/or any other connector extending through the guide passage 140) is also generally coaxial with the steering axis 80 along the vertical segment 164.

With the flexible rigging connector 40 coaxial to the steering axis 80, wear experienced by the flexible rigging connector 40 during operation of the marine drive 50 is reduced. As a user steers the marine drive 50 by rotating it about the steering axis 80 using the tiller 59, the flexible rigging connector 40 may twist within the guide passage 140 about the steering axis 80, but overall movement and deflection of the flexible rigging connector 40 is minimized. Alignment of the flexible rigging connector 40 with the steering axis 80 reduces any forces which act on the flexible rigging connector 40 to push or pull the flexible rigging connector 40 in or out of the cowling 56. By supporting the flexible rigging connector 40 and holding it above the transom 32 and transom bracket assembly 60, the guide member 130 prevents the flexible rigging connector 40 from rubbing against the upper surfaces of the transom 32 and transom bracket assembly 60, thereby reducing wear on the flexible rigging connector 40. The guide member 130 additionally protects the flexible rigging connector 40 as the marine drive 50 is trimmed up or down about the trim axis 68. Because the guide member 130 is rigidly coupled to the swivel bracket 64, the guide member 130 and the flexible rigging connector 40 move with the marine drive 50 as it is trimmed, thereby maintaining the position of the flexible rigging connector 40 relative to the marine drive 50. This minimizes the forces exerted on the flexible rigging connector 40 as the marine drive 50 is trimmed and prevents the flexible rigging connector 40 from excessive bending.

In the present description, certain terms have been used for brevity, clarity, and understanding. No unnecessary limitations are to be implied therefrom beyond the requirement of the prior art because such terms are used for descriptive purposes only and are intended to be broadly construed. The different apparatuses described herein may be used alone or in combination with other apparatuses. Various equivalents, alternatives and modifications are possible within the scope of the appended claims.

What is claimed is:

1. A marine drive for propelling a marine vessel in water, the marine drive comprising:

a supporting frame that is steerable about a steering axis;

a cowling defining a cowling interior that encloses at least a portion of the supporting frame;

a flexible rigging connector extending from the cowling interior and configured to couple a component of the marine drive to a component of the marine vessel; and a guide member that guides a first portion of the flexible rigging connector generally coaxial to the steering axis and a second portion of the flexible rigging connector transversely relative to the steering axis towards the marine vessel.

2. The marine drive according to claim 1, further comprising a steering arm for steering the marine drive, wherein the first portion of the flexible rigging connector extends through the steering arm.

3. The marine drive according to claim 2, wherein the guide member extends through the steering arm.

4. The marine drive according to claim 1, wherein the guide member includes a first portion that supports the first portion of the flexible rigging connector, a second portion that supports the second portion of the flexible rigging connector, and a bend that transitions the first portion of the guide member to the second portion of the guide member.

5. The marine drive according to claim 1, wherein the guide member includes a base member and a cover that is removable from the base member, the base member and the cover together defining a guide passage for the flexible rigging connector.

6. The marine drive according to claim 1, wherein the guide member has a first end located inside the cowling interior and a second end located outside of the cowling interior.

7. The marine drive according to claim 1, further comprising a transom bracket assembly configured to couple the marine drive to the marine vessel, wherein the guide member guides the second portion of the flexible rigging connector over the transom bracket assembly.

8. The marine drive according to claim 1, further comprising a transom bracket configured for fixed attachment to the marine drive and a swivel bracket that is configured for fixed attachment to the marine drive, the swivel bracket being pivotably coupled to the transom bracket to facilitate trimming of the marine drive relative to a trim axis, wherein the guide member is coupled to the swivel bracket so the guide member moves with the marine drive relative to the trim axis.

9. The marine drive according to claim 1, wherein the flexible rigging connector includes a power cable for coupling a power terminal on the marine drive to a battery on the marine vessel.

10. A marine drive for propelling a marine vessel in water, the marine drive comprising:

a supporting frame that is steerable about a steering axis;

a cowling defining a cowling interior that encloses at least a portion of the supporting frame;

a flexible rigging connector extending from the cowling interior and configured to couple a component of the marine drive to a component of the marine vessel; and a steering arm for steering the marine drive relative to a steering axis, wherein the flexible rigging connector extends through a through-bore in the steering arm that is generally coaxial with the steering axis and then transversely relative to the steering axis towards the marine vessel.

11. The marine drive according to claim 10, further comprising a guide member that guides a first portion of the flexible rigging connector generally coaxial to the steering axis and a second portion of the flexible rigging connector transversely relative to the steering axis towards the marine vessel.

12. The marine drive according to claim 11, wherein the guide member extends through the through-bore in the steering arm.

13. The marine drive according to claim 11, wherein the guide member includes a first portion that supports the first portion of the flexible rigging connector, a second portion that supports the second portion of the flexible rigging connector, and a bend that transitions the first portion of the guide member to the second portion of the guide member.

14. The marine drive according to claim 11, wherein the guide member includes a base member and a cover that is removable from the base member, the base member and the cover together defining a guide passage for the flexible rigging connector.

15. The marine drive according to claim 11, wherein the guide member has a first end located inside the cowling interior and a second end located outside of the cowling interior.

16. The marine drive according to claim 11, further comprising a transom bracket assembly configured to couple the marine drive to the marine vessel, wherein the guide member guides the second portion of the flexible rigging connector over the transom bracket assembly.

17. The marine drive according to claim 11, further comprising a transom bracket configured for fixed attachment to the marine drive and a swivel bracket that is configured for fixed attachment to the marine drive, the swivel bracket being pivotably coupled to the transom bracket to facilitate trimming of the marine drive relative to a trim axis, wherein the guide member is coupled to the swivel bracket so the guide member moves with the marine drive relative to the trim axis.

18. The marine drive according to claim 10, wherein the flexible rigging connector includes a power cable for coupling a power terminal on the marine drive to a battery on the marine vessel.

19. A marine drive for propelling a marine vessel in water, the marine drive comprising:

a cowling defining a cowling interior;

a steering arm for steering the marine drive with respect to a steering axis;

a flexible rigging connector extending from the cowling interior to a location in the marine vessel, wherein the flexible rigging connector extends through the steering arm;

a transom bracket assembly configured to couple the marine drive to the marine vessel, the transom bracket assembly including a transom bracket configured for fixed attachment to the marine drive and a swivel bracket that is configured for fixed attachment to the marine drive, the swivel bracket being pivotably coupled to the transom bracket so as to facilitate trimming of the marine drive relative to the marine vessel about a trim axis; and a guide member that guides the flexible rigging connector over the transom bracket assembly, wherein the guide member is coupled to the swivel bracket so the guide member moves with the marine drive when the marine drive is trimmed about the trim axis.

20. The marine drive according to claim 19, wherein the flexible rigging connector extends through a through-bore in the steering arm that is generally coaxial with the steering axis and then transversely relative to the steering axis towards the marine vessel.

21. The marine drive according to claim 19, wherein the guide member extends through the steering arm.

22. The marine drive according to claim 19, wherein at least a portion of the flexible rigging connector extends coaxial with the steering axis.

23. The marine drive according to claim 19, wherein the guide member has a first end located inside the cowling interior and a second end located outside of the cowling interior.

24. The marine drive according to claim 19, wherein the guide member comprises a base member and a cover which is removable from the base member, and wherein the base member and the cover together define a guide passage for the flexible rigging connector.

* * * * *